United States Patent [19]

Kosal et al.

[11] Patent Number: 4,534,880

[45] Date of Patent: Aug. 13, 1985

[54] DETERGENT COMPOSITION WITH SILICONATE-ZEOLITE AND SILICATE BUILDER

[75] Inventors: Jeffrey A. Kosal; Edwin P. Plueddemann, both of Midland, Mich.

[73] Assignee: Dow Corning Corporation, Midland, Mich.

[21] Appl. No.: 593,986

[22] Filed: Mar. 27, 1984

[51] Int. Cl.[3] ..... C11D 3/08; C11D 3/12

[52] U.S. Cl. ..... 252/174.13; 252/134; 252/174; 252/174.15; 252/174.16; 252/525; 252/527; 252/545; 252/546

[58] Field of Search ..... 252/174.13, 174.15, 252/174.16, 174.25, 179, 174, 181, 135, 525, 527, 545, 546, DIG. 17; 428/405; 502/62

[56] References Cited

U.S. PATENT DOCUMENTS 4,138,363 2/1979 Hertzenberg et al. ..... 252/430
4,216,125 8/1980 Campbell et al. ..... 252/527
4,243,545 1/1981 Campbell et al. ..... 252/140
4,419,252 12/1983 Allen et al. ..... 252/8.6
4,421,657 12/1983 Allen et al. ..... 252/8.6
4,454,056 6/1984 Kittelmann et al. ..... 252/174.15

FOREIGN PATENT DOCUMENTS 87035 8/1983 European Pat. Off. .

*Primary Examiner*—Prince E. Willis
*Attorney, Agent, or Firm*—James E. Bittell

[57] ABSTRACT

The preparation and applications of anionic siliconate-zeolite composites are disclosed. The composites are formed by coating the surface of zeolite particles with an aqueous solution of an anionic functional organosiliconate. The composites are particularly useful as components of soluble silicate containing detergent compositions since they do not agglomerate with the soluble silicates to form large insoluble particulates that can deposit on fabrics during laundry. Detergent compositions containing the composites are disclosed.

18 Claims, No Drawings

DETERGENT COMPOSITION WITH SILICONATE-ZEOLITE AND SILICATE BUILDER

BACKGROUND OF THE INVENTION

This invention relates to the field of zeolites and their use in detergent formulations. In particular, it relates to zeolites coated with anionic functional organosilicon compounds. The coated zeolite has improved properties making it more useful in detergent formulations.

Zeolites are well known ion exchange agents that have been used recently to replace all or part of the phosphates in several detergent formulations. However, the use of zeolites in detergents has generated several problems. In particular, the zeolites tend to agglomerate during industrial preparation of detergent formulations. It has been suggested that the agglomeration results from the interaction of the zeolite with other detergent ingredients during the spray drying process. These agglomerates deposit on the fabric being laundered and are especially noticeable as white particulate material on dark fabrics.

Alkali metal silicates have been implicated as one of the components of detergents that may interact with zeolites to cause the agglomeration. Consequently, it has been proposed that only limited amounts of silicate, 3% or less, should be used in zeolite built detergents. Larger amounts of alkali metal silicate have been shown to decrease the ion exchange capacity and the rate of ion exchange of the zeolite in the detergent. Soluble silicates, however, are valuable components in detergent formulations for their bead formation, anticorrosion and other functions that make detergent processing and use easier.

U.S. Pat. Nos. 4,138,363, 4,216,125 and 4,243,545 teach that the tendency of zeolites to agglomerate during detergent processing can be reduced by treating the zeolite surface with a hydrophilic functional silane. While acrylates, epoxies, amines and carboxylates are suggested as useful hydrophilic groups, the only silanes taught for treating the zeolite were beta-3,4-epoxycyclohexyl-ethyltrimethoxysilane, gamma-glycidoxypropyltrimethoxysilane and gamma-aminopropyltrimethoxysilane. However, the improvements achieved with these silane-zeolite composites has not been sufficient to result in commercial utilization.

Consequently there is still a need for a commercially viable way of modifying zeolite so that it can be incorporated in soluble silicate containing detergent formulations without agglomeration problems. Furthermore, it is important that the zeolite can be incorporated into the detergent formulation without reducing its ion exchange properties. Accordingly, it is a purpose of the present invention to provide an improved method of modifying the properties of zeolite so that it can be incorporated into soluble silicate containing detergent formulations without producing agglomerates that deposit as white particulate material on fabric during laundry. It is a further object of the present invention to provide a zeolite that retains its capacity and rate of ion exchange when formulated in a detergent containing substantial amounts of alkali metal silicates.

SUMMARY OF THE INVENTION

The present invention provides improved detergent compositions comprising (A) 5 to 40 percent by weight of an organic surfactant selected from the group consisting of anionic, nonionic and ampholytic surfactants; (B) 1 to 50 percent by weight of an anionic siliconate-zeolite composite containing zeolite with a surface coating of 0.1 to 10 percent by weight of anionic functional siliconate; and (C) 1 to 20 percent by weight of a water soluble alkali metal silicate. The invention further relates to the anionic siliconate-zeolite composite which is useful in the detergent formulations.

DETAILED DESCRIPTION OF THE INVENTION

The present invention is based on the discovery that anionic siliconate-zeolite composites can be prepared by contacting the zeolite with an aqueous solution of an anionic functional siliconate and evaporating any excess water at a relatively low temperature. The anionic siliconate-zeolite composites are especially useful in detergent formulations because they are less likely to interact with soluble silicates in the detergent to form agglomerates during processing or storage.

The anionic siliconate-zeolite composite of the present invention can be formed with a variety of synthetic and natural zeolites. In general, synthetic zeolites are usually employed because they are more readily available and are specially manufactured to have more desirable and consistent properties. Synthetic crystalline sodium alumina silicates such as those described in U.S. Pat. Nos. 2,882,243, 3,012,853, 3,130,007, and 3,329,628, 4,303,629 among others, are suitable to form anionic siliconate-zeolite composites. While any zeolite can be used to prepare the composite, it is usually preferred to employ zeolites conforming to the general formula:

$$Na_x[(AlO_2)_x(SiO_2)_y]zH_2O$$

where x and y are integers of at least 6; the ratio of x to y is in the range of 0.1 to 1.1; and z is an integer from about 8 to 270. In general, the water content of these zeolites is 15 to 35 percent by weight of the zeolite. Specific examples of useful zeolites include among others, zeolites generally conforming to the formula, $Na_{12}[AlO_2)_{12}(SiO_2)_{12}]20H_2O$ and zeolites generally conforming to the formula $Na_x[(AlO_2)_x(SiO_2)_y]zH_2O$ where x is an integer between 80 and 96 and y is an integer between 112 and 96 and z is between 220 and 270. Zeolites are well known in the art and have been described in many patents in recent years for use as builders in laundry detergent formulations.

The anionic siliconates used to prepare the zeolite composite are organosilicon compounds in which the organic substituent is attached to silicon by a silicon-carbon bond. The organic substitutent also carris an anionic functional group which is attached to the substituent at least 2 and preferably 3 or more carbon atoms removed from the bond to silicon. An anionic functional group is a group that exists predominately in a disassociated ionic state in aqueous solutions and thus provides the organic substituent attached to silicon with a negative charge. Anionic functional groups can be described generally as salts of oxyacids. Anionic functional groups include salts of sulfonic acids, salts of phosphonic acid, salts of monoesters of phosphonic acids, and salts of carboxylic acids. Generally the alkali metal salts of the acids are preferred although salts derived from other bases such as organic quaternary ammonium hydroxide compounds can also be employed in this invention.

It should be understood that the organic substituent of the siliconate may also contain other functionality such as ether, sulfide, hydroxy, and amine. Anionic siliconates are known materials and are described further in U.S. Pat. Nos. 3,198,820, 3,816,184, 4,235,638, 4,344,860, 4,352,742, 4,354,002, 4,362,644 and 4,370,255 which are hereby incorporated by reference to further illustrate the anionic functional siliconates and to show methods for their preparation.

The general form of the anionic siliconates can be represented by the formula:

$$(MO)_aO_{(3-a)/2}Si—R—Y_b$$

wherein R is an organic linking group wherein the anionic functionality or any other functionality is positioned at least 2 and preferably at least 3 carbon atoms removed from the silicon atom and Y represents anionic functional groups and b represents the number of anionic functional groups on the linking group and can vary from 1 to 3. In the formula, M represents the cation of a strong base such as alkali metal cations or organo quaternary ammonium cations or M represents a hydrogen such that the siliconate also contains silanol functionality. Generally a can vary from about 1 to 3.

It is preferred that a has the value of 3 to about 2 such that the anionic siliconate is predominately a monomeric species in aqueous solutions. Monomers are preferred because they are believed to bond more rapidly to the zeolite particle surface. It should be understood however that oligomeric anionic siliconates where a is 1 to about 2 are also useful in the invention. Under alkaline conditions the oligomers are in equilibrium with monomers so that they can also readily bond to the zeolite surface by an equilibration process. It should also be apparent that if desired the equilibrium can be shifted toward monomeric species by the addition of alkali metal hydroxide to the aqueous solution of the siliconate.

The organic linking group, R, may contain other atoms in addition to carbon and hydrogen such as, for example, oxygen, sulfur, and nitrogen. These atoms may be present, as other functional groups such as, for example, ether, sulfide, hydroxy, amide, or amine. Other functionality as represented by these exemplary atoms should be positioned at least 2 and preferably 3 or more carbon atoms removed from the site of silicon atom attachment in the linking group. Such positioning of functionality within the linking group provides substituents on silicon that are more stable and less readily cleaved. Generally it is preferred that the linking group contain from 2 to a maximum of about 16 carbon atoms. While linking groups with greater than 16 carbon atoms may be used in the invention, it is believed that the hydrophobic character produced by such linking groups reduce the effectiveness of the siliconates so that linking groups with greater than 16 carbon atoms are less preferred.

Linking groups represented by R include, among others, polyvalent hydrocarbon radicals such as dimethylene, trimethylene, hexadecamethylene, phenylene, tolylene, xenylene, naphthylene, and substituted polyvalent hydrocarbon radicals such as $$—(CH_2)_3OCH_2CH(OH)CH_2—,\ —(CH_2)_3SCH_2—,$$

-continued $$—(CH_2)_3NHC(=O)CH(CH_2—)—,\ —(CH_2)_3N(CH_2CH_2—)(CH_2CH_2—)CH_2CH_2—,$$

$$—(CH_2)_3N(CH_2CH_2—)CH_2CH_2—,$$

$$—CH_2CH(CH_3)CH_2NHCH_2CH_2N(CH_2—)—CH_2—, \text{ and}$$

$$—(CH_2)_3SCH(CH_2—)—.$$

Generally when M is an alkali metal cation it is preferred that it be sodium because of its ready availability and low cost. Similarly, the sodium salts of the oxyacids are preferred anionic functional groups in the siliconates.

For example anionic siliconates suitable for the present inventin include compositions conforming generally to the formulas:

$$(NaO)_{0.2}(HO)_{2.8}SiCH_2CH_2CH_2OP(=O)(CH_3)—O^-Na^+,$$

$$(NaO)_{0.1}(HO)_{1.9}O_{\frac{1}{2}}SiCH_2CH_2CH_2—P(=O)(O^-Na^+)_2,$$

$$(NaO)_{0.2}(HO)_{2.8}Si(CH_2)_6SO_3^-Na^+,$$

$$(HO)_3SiCH_2CH_2CH_2OCH_2CH(OH)CH_2SO_3^-Na^+,$$

$$(HO)_2O_{\frac{1}{2}}SiCH_2CH_2—C_6H_5—SO_3^-K^+,$$

$$(KO)_{0.2}(HO)_{1.8}O_{\frac{1}{2}}SiCH_2CH_2SCH_2COO^-K^+,$$

$$(NaO)_{0.1}(HO)_{1.9}O_{\frac{1}{2}}SiCH_2CH_2CH_2SCH(CH_2COO^-Na^+)COO^-Na^+,$$

$$(HO)_3SiCH_2CH(CH_3)CH_2N(CH_2CH_2COO^-Na^+)_2,$$

$$(HO)_3SiCH_2CH_2CH_2NHCH_2CH_2N(CH_2COO^-Na^+)_2,$$

$$(NaO)_{0.2}(HO)_{2.8}SiCH_2CH_2CH_2N(CH_2CH_2COO^-Na^+)CH_2CH_2N(CH_2CH_2COO^-Na^+)_2,$$

$$(NaO)_{0.1}(HO)_{2.9}SiCH_2CH_2CH_2NHC(=O)CH(CH_2COO^-Na^+)SO_3^-Na^+,$$

$$(NaO)_{0.2}(HO)_{2.8}SiCH_2CH_2CH_2N(CH_2SO_3^-Na^+)CH_2CH_2N(CH_2SO_3^-Na^+)_2, \text{ and}$$

$$(NaO)_{0.2}(HO)_{1.8}O_{\frac{1}{2}}SiCH_2CH_2COO^-Na^+.$$

The anionic siliconates in which the organic substituent on silicon contains more than one anionic functional group are preferred because of their more highly anionic character and because of their improved effectiveness in reducing the silicate induced agglomeration of zeolite particles. Specifically anionic functional siliconates represented by the formula $$(MO)_aO_{(3-a)/2}Si—R—Y_b$$

wherein b has the value 2 or 3 are preferred. One especially preferred siliconate is represented generally by the formula $$(NaO)(HO)_2SiCH_2CH_2CH_2N(CH_2CH_2COO^-Na^+)_2.$$
$$\quad\quad\quad the detergent can be selected and they dry blended to provide the final composition.

In order that those skilled in the art may better understand how the present invention can be practiced, the following examples are given by way of illustration and not by way of limitation. All parts and percents referred to herein are by weight unless otherwise noted.

EXAMPLE 1

Three anionic siliconate-zeolite composites were prepared employing three siliconates with different types of anionic functional groups.

Composite I was prepared by mixing a slurry of 1000 g of Na-Zeolite A (a commercially available zeolite supplied under the name Valfor ® 100 by PQ Corporation, Valley Forge, Pa.) and 1000 g water with 189 g of an aqueous solution of 52.7 percent anionic siliconate I which conforms generally to the formula $$(NaO)_{0.1}(HO)_{2.9}Si(CH_2)_3O-\underset{\underset{CH_3}{|}}{\overset{\overset{O}{\|}}{P}}-O^-Na^+.$$

The slurry was heated to about 65° C. and stirred for 10 minutes. The water was evaporated from the slurry until a dry appearing composite cake was obtained. This material was ground to a free flowing powder form. Composite I represents a zeolite with a coating of about 9 percent siliconate.

Composite II was prepared by forming a slurry of 1000 g of Na-Zeolite A and 1000 g water and mixing the slurry with 195 g of an aqueous solution of 51.4% percent anionic siliconate II which conforms generally to the formula $$(NaO)_{0.3}(HO)_{2.7}Si(CH_2)_3\underset{\underset{CH_2CH_2COO^-Na^+}{|}}{N}CH_2CH_2N(CH_2CH_2COO^-Na^+)_2.$$

The slurry was dried and ground to a free flowing powder as described above. Composite II represents a zeolite with a coating of about 9 percent siliconate.

Composite III was prepared by forming a slurry of 1000 g of the Na-Zeolite A and 1000 g water and mixing the slurry with 14 g of an aqueous solution of 65% percent anionic siliconate III which conforms generally to the formula $$(NaO)_{0.3}(HO)_{2.7}Si(CH_2)_3\underset{\underset{CH_2CH_2SO_3^-Na^+}{|}}{N}CH_2CH_2N(CH_2CH_2SO_3^-Na^+)_2.$$

The slurry was dried and ground to a free flowing powder as described above. Composite III represents a zeolite with a coating of about 0.9 percent siliconate.

EXAMPLE 2

This example shows that the ion exchange capacity and rate of ion exchage for zeolites coated with anionic siliconates are not adversely affected by the anionic siliconate coating.

A series of siliconate-zeolite composites were prepared by the method of Example 1 using Na-Zeolite A and various coating amounts of anionic siliconates I and II as described in Example 1. A 0.1 g portion of each siliconate-zeolite composite was added to a 50 ml portion of a stock solution containing 272 ppm $Ca^{+2}$ as calcium chloride. The siliconate-zeolite composite was mixed in the $Ca^{+2}$ containing water for precisely two minutes and then the mixture was quickly filtered to remove the siliconate-zeolite composite from the water. The filtrate was then titrated with a standard solution of ethylenediaminetetraacetic acid to determine the amount of $Ca^{+2}$ remaining in the filtrate. The results are presented in Table 1. The amount of $Ca^{+2}$ remaining after a similar test employing 0.1 g of uncoated Na-Zeolite A is presented in Table 1 for comparison.

TABLE 1

Calcium Ion Exchange Properties of Siliconate Coated Zeolite

| Anionic Siliconate | Siliconate Coating Amount | Amount of $Ca^{+2}$ Left After Zeolite Treatment (ppm) |
|---|---|---|
| None (control) | 0 | 122 |
| I | 1% | 120 |
| I | 5% | 92 |
| I | 10% | 128 |
| II | 1% | 120 |
| II | 5% | 90 |
| II | 10% | 100 |

EXAMPLE 3

This example illustrates the preparation of powdered detergent compositions containing the anionic siliconate-zeolite composite.

A powder detergent composition was prepared with each of the anionic siliconate-zeolite composites prepared in Example 1. The detergent compositions were prepared by first forming a slurry of the following composition:

| | |
|---|---|
| 800 g | Sodium salt of dodecylbenzenesulfonic acid (60% solids) |
| 240 g | Sodium sulfate |
| 405 g | Sodium silicate solids (2.4 $SiO_2/Na_2O$) |
| 867 g | Anionic siliconate-zeolite composite |
| 400 g | Sodium carbonate |
| 2695 g | Water |

The slurries were spray dried utilizing a laboratory scale, rotary spray dryer. The conditions for drying were selected to provide about 6 percent water in the final powdered product. The drying of these slurries was free from problems and no agglomeration of the powders was noted during the processing. Detergent Compositions A, B, C and D were prepared containing respectively uncoated Na-Zeolite A, zeolite composite I, zeolite composite II, and zeolite composite III, all as described in Example 1. Detergent Composition A is outside the scope of this invention and is presented for comparison purposes only.

EXAMPLE 4

This example shows that the ion exchange capacity and rate of ion exchange for detergent compositions containing anionic siliconate coated zeolites is not adversely affected in comparison to an equivalent detergent formulation containing uncoated zeolite.

A 0.2 g portion of each detergent composition from Example 4 was added to a 50 ml portion of a stock solution containing 272 ppm $Ca^{+2}$ as calcium chloride. The detergent was mixed in the $Ca^{+2}$ containing water for precisely two minutes and the mixture was quickly filtered to remove all undissolved portions of the detergent powder. The filtrate was titrated as in Example 2 and the amounts of $Ca^{+2}$ found remaining in the filtrate is presented in Table 2.

TABLE 2

Calcium Ion Exchange Properties of Powder Detergent Compositions

| Detergent Composition | Anionic Siliconate-Zeolite Composite Used | Amount of $Ca^{+2}$ Left After Detergent Treatment (ppm) |
|---|---|---|
| A (control) | Uncoated Na—Zeolite A | 78 |
| B | I | 56 |
| C | II | 76 |
| D | III | 60 |

EXAMPLE 5

This example shows a comparison of the amount of agglomerated zeolite particles formed in detergent compositions of this invention and conventional detergent compositions.

The detergent compositions prepared in Example 3 were evaluated by a black cloth test to determine the extent of zeolite agglomerate particles that would be retained on fabric while laundering. For the test, 0.75 g of the powder detergent composition was agitated for 10 minutes in 1000 ml of deionized water with an impellor blade stirrer operating at 350 rpm. After agitation, the mixture was vacuum filtered through a 13 mm diameter piece of black broad cloth. After the cloth had air dried, the reflectivity of the cloth was measured. A higher reflectivity corresponds to retention of a higher amount of white particles on the black cloth. The results are shown in Table 3.

TABLE 3

Black Cloth Test for Agglomerated Zeolite Particles

| Detergent Composition | Anionic Siliconate-Zeolite Composite Employed | Reflectivity |
|---|---|---|
| A (control) | Uncoated Na—Zeolite A | 51 |
| B | I | 0 |
| C | II | 0 |
| D | III | 42 |

EXAMPLE 6

This example shows a comparison of the amount of agglomerated zeolite particles formed in detergent compositions of this inventon and a detergent composition containing zeolite treated with gamma-glycidoxypropyltrimethoxysilane.

Anionic siliconate-zeolite composites were prepared with various levels of siliconate on the zeolite by the procedure described in Example 1. The composites were incorporated into a detergent formulation as described in Example 3 using the rotary spray dryer. Drying conditions were varied to provide two samples of each composition, one sample with about 7 weight percent residual water and one with about 12 weight percent residual water.

A comparison zeolite composite was prepared by first dissolving gamma-glycidoxypropyltrimethoxysilane in an approximately equal amount of water that was acidified to pH 4 with HCl. This aqueous solution was employed to prepare a silane-zeolite composite by the same procedure used to form the siliconate-zeolite composites. This silane-zeolite composite was then incorporated into the same detergent formulation used with the siliconate-zeolite composites. These granular detergent compositions were evaluated by the black cloth test as described in Example 5. Results are presented in Table 4.

TABLE 4

Black Cloth Test Comparison for Granular Detergent Compositions

| Zeolite Treatment | Weight Percent of Siliconate on the Zeolite | Weight Percent Residual Water in the Detergent | Reflectivity of Black Cloth |
|---|---|---|---|
| None | 0 | 6.7 | 16 |
| None | 0 | 8.3 | 24 |
| Silane[1] | 2 | 6.4 | 15 |
| Silane[1] | 2 | 11.8 | 2.4 |
| Siliconate I[2] | 4 | 5.8 | 13 |
| Siliconate I[2] | 4 | 11.4 | 0 |
| Siliconate I[2] | 2 | 7.6 | 19 |
| Siliconate I[2] | 2 | 12.9 | 2.0 |
| Siliconate II[2] | 2 | 6.6 | 15 |
| Siliconate II[2] | 2 | 11.5 | 0 |
| Siliconate II[2] + 2NaOH | 2 | 7.0 | 1.5 |
| Siliconate II[2] + 2NaOH | 2 | 11.5 | 0 |

[1]Gamma-glycidoxypropyltrimethoxysilane
[2]See Example 1 for general formulas

That which is claimed is:

1. A detergent composition comprising
(A) 5 to 40 percent by weight of an organic surfactant selected from the group consisting of anionic, nonionic and ampholytic surfactants;
(B) 1 to 50 percent by weight of an anionic siliconate-zeolite composite containing zeolite with a surface coating of 0.1 to 10 percent by weight of anionic functional siliconate represented by the formula $$(MO)_aO_{(3-a)/2}Si—R—Y_b$$

wherein Y represents an alkali metal salt of an oxyacid group, R is an organic linking group wherein Y or other functionality selected from the group consisting of ether, sulfide, hydroxy, amide and amine is positioned at least 2 carbon atoms removed from the silicon atom, a has a value of from 1 to 3, b is an integer from 1 to 3, and M is an alkali metal cation or hydrogen; and
(C) 1 to 20 percent by weight of a water soluble alkali metal silicate.

2. The detergent composition of claim 1 wherein the alkali metal salt of the oxyacid is selected from the group consisting of alkali metal salts of sulfonic acids, phosphonic acids, monoesters of phosphonic acids and carboxylic acids.

3. The detergent composition of claim 2 wherein the organic linking grop, R, contains 2 to 16 carbon atoms and is selected from the group consisting of radicals composed of carbon and hydrogen; radicals composed of carbon, hydrogen and oxygen; radicals composed of carbon, hydrogen and sulfur; and radicals composed of carbon, hydrogen and nitrogen.

4. The detergent composition of claim 3 wherein b is 2 or 3.

5. The detergent composition of claim 4 wherein Y is an alkali metal salt of a carboxylic acid group.

6. The detergent composition of claim 5 wherein R is a radical composed of carbon, hydrogen and nitrogen atoms.

7. The detergent composition of claim 6 wherein the anionic functional siliconate is represented by the formula $$(MO)_aO_{(3-a)/2}SiCH_2CH_2CH_2\underset{\underset{CH_2CH_2COO^-Na^+}{|}}{N}CH_2CH_2N(CH_2CH_2COO^-Na^+)_2$$

wherein M is hydrogen or sodium.

8. The detergent composition of claim 6 wherein the anionic functional siliconate is represented by the formula $$(MO)_aO_{(3-a)/2}SiCH_2CH_2CH_2\underset{\underset{CH_2COO^-Na^+}{|}}{N}CH_2CH_2N(CH_2COO^-Na^+)_2$$

wherein M is hydrogen or sodium.

9. The detergent composition of claim 3 wherein Y is the sodium salt of a monoester of phosphonic acid.

10. The detergent composition of claim 9 wherein the anionic functional siliconate is represented by the formula $$(MO)_aO_{(3-a)/2}SiCH_2CH_2CH_2\underset{\underset{CH_3}{|}}{\overset{\overset{O}{\|}}{P}}-O^-Na^+$$

wherein M is hydrogen or sodium.

11. A composition consisting essentially of (A) 90 to 99.9 percent by weight of zeolite in the sodium form, containing 15 to 35 percent water, and (B) coated on the surface of the zeolite, 0.1 to 10 percent by weight of anionic functional siliconate represented by the formula $$(MO)_aO_{(3-a)/2}Si-R-Y_b$$

wherein Y represents an alkali metal salt of an oxyacid group, R is an organic linking group wherein Y or other functionality selected from the group consisting of ether, sulfide, hydroxy, amide and amine is positioned at least 2 carbon atoms removed from the silicon atom, a has a value of from 1 to 3, b is an integer from 1 to 3, and M is an alkali metal cation or hydrogen.

12. The compositions of claim 11 wherein the alkali metal salt of the oxyacid is selected from the group consisting of alkali metal salts of sulfonic acids, phosphonic acids, monoesters or phosphonic acids and carboxylic acids.

13. The composition of claim 12 wherein the organic linking group, R, contains 2 to 16 carbon atoms and is selected from the group consisting of radicals composed of carbon and hydrogen; radicals composed of carbon, hydrogen and sulfur; radicals composed of carbon, hydrogen and oxygen; and radicals composed of carbon, hydrogen and nitrogen.

14. The composition of claim 13 wherein b is 2 or 3 and Y is an alkali metal salt of a carboxylic acid group.

15. The composition of claim 14 wherein R is a radical composed of carbon, hydrogen and nitrogen atoms.

16. The composition of claim 15 wherein the anionic functional siliconate is represented by the formula $$(MO)_aO_{(3-a)/2}SiCH_2CH_2CH_2\underset{\underset{CH_2CH_2COO^-Na^+}{|}}{N}CH_2CH_2N(CH_2CH_2COO^-Na^+)_2$$

wherein M is hydrogen or sodium.

17. The composition of claim 13 wherein Y is the sodium salt of a monoester of phosphonic acid.

18. The composition of claim 17 wherein the anionic functional siliconate is represented by the formula $$(MO)_aO_{(3-a)/2}SiCH_2CH_2CH_2\underset{\underset{CH_3}{|}}{\overset{\overset{O}{\|}}{P}}-O^-Na^+$$

wherein M is hydrogen or sodium.

* * * * *